US010954650B2

(12) United States Patent
Myers et al.

(10) Patent No.: US 10,954,650 B2
(45) **Date of Patent: *Mar. 23, 2021**

(54) HYDRAULIC DERATE STABILITY CONTROL

(71) Applicant: Deere & Company, Moline, IL (US)

(72) Inventors: David J. Myers, Asbury, IA (US); Doug M. Lehmann, Centralia, IA (US); Aaron R. Kenkel, East Dubuque, IL (US); Kyle E. Leinaar, Dubuque, IA (US); Brian K. Kellogg, Bellevue, IA (US)

(73) Assignee: DEERE & COMPANY, Moline, IL (US)

( * ) Notice: Subject to any disclaimer, the term of this patent is extended or adjusted under 35 U.S.C. 154(b) by 258 days.

This patent is subject to a terminal disclaimer.

(21) Appl. No.: 15/908,555

(22) Filed: Feb. 28, 2018

(65) Prior Publication Data

US 2019/0264418 A1 Aug. 29, 2019

(51) Int. Cl.
*E02F 9/22* (2006.01)
*E02F 3/42* (2006.01)
(Continued)

(52) U.S. Cl.
CPC ..... *E02F 3/422* (2013.01); *E02F 3/283* (2013.01); *E02F 9/2004* (2013.01);
(Continued)

(58) Field of Classification Search
CPC . E02F 3/283; E02F 3/342; E02F 3/422; E02F 9/2228; E02F 9/26; E02F 9/264
See application file for complete search history.

(56) References Cited

U.S. PATENT DOCUMENTS 5,180,028 A 1/1993 Perrenoud, Jr.
5,692,376 A 12/1997 Miki et al.
(Continued)

FOREIGN PATENT DOCUMENTS

DE 19901563 A1 7/2000
DE 10163066 A1 7/2003
(Continued)

OTHER PUBLICATIONS

Jafar M Hassan of the University of Technology, Baghdad, "An Experimental Study Into the Effect of Temperature and Pressure on the Hydraulic System" (Year: 2009).*
(Continued)

*Primary Examiner* — Hunter B Lonsberry
*Assistant Examiner* — Matthew J. Reda
(74) *Attorney, Agent, or Firm* — Michael Best & Friedrich LLP

(57) ABSTRACT

A work machine includes a mechanical arm and a work implement coupled to the mechanical arm. The work implement is configured to receive a load. A hydraulic actuator is coupled to the mechanical arm to move the arm between a first position and a second position. A sensor unit is configured to detect the load in the work implement. A valve is in fluid communication with the hydraulic actuator for supplying a fluid output to the hydraulic actuator. A controller is in communication with the value and the sensor unit. The controller is configured to transmit a control signal to the valve to adjust the fluid output to the hydraulic actuator, and wherein the controller is configured to derate the fluid output in response to a signal from the sensor unit that a load is at or above a threshold value.

20 Claims, 6 Drawing Sheets

(51) Int. Cl.
*E02F 3/28* (2006.01)
*E02F 9/20* (2006.01)
*E02F 3/342* (2006.01)

(52) U.S. Cl.
CPC ..... *E02F 9/2225* (2013.01); *E02F 9/2267* (2013.01); *E02F 9/2271* (2013.01); *E02F 3/342* (2013.01)

(56) References Cited

U.S. PATENT DOCUMENTS

| | | | | |
|---|---|---|---|---|
| 6,047,228 | A | 4/2000 | Stone et al. | |
| 6,175,796 | B1 | 1/2001 | Ishikawa | |
| 6,437,701 | B1 | 8/2002 | Muller | |
| 6,552,279 | B1 * | 4/2003 | Lueschow | G01G 19/10 177/141 |
| 6,615,581 | B2 | 9/2003 | Kusuyama | |
| 6,802,687 | B2 | 10/2004 | Litchfield et al. | |
| 6,868,672 | B2 | 3/2005 | Luo | |
| 7,276,669 | B2 | 10/2007 | Dahl et al. | |
| 7,518,523 | B2 | 4/2009 | Yuan et al. | |
| 7,610,136 | B2 | 10/2009 | Okamura et al. | |
| 7,630,793 | B2 | 12/2009 | Thomas et al. | |
| 8,751,117 | B2 | 6/2014 | Ekvall et al. | |
| 9,068,323 | B2 | 6/2015 | Peterson et al. | |
| 9,074,352 | B2 | 7/2015 | Ramun | |
| 9,206,026 | B2 | 12/2015 | Aulton et al. | |
| 9,238,903 | B2 | 1/2016 | Saito | |
| 9,593,461 | B2 | 3/2017 | Faivre et al. | |
| 9,822,507 | B2 | 11/2017 | Singh et al. | |
| 2006/0108185 | A1 * | 5/2006 | Bitter | B66F 9/0655 188/151 R |
| 2008/0201043 | A1 | 8/2008 | Sahlin et al. | |
| 2009/0082930 | A1 | 3/2009 | Peters | |
| 2009/0171482 | A1 | 7/2009 | Mindeman et al. | |
| 2010/0204891 | A1 * | 8/2010 | Biggerstaff | E02F 3/3414 701/50 |
| 2010/0268410 | A1 | 10/2010 | Vigholm et al. | |
| 2011/0046857 | A1 | 2/2011 | Farmer et al. | |
| 2012/0291427 | A1 | 11/2012 | Azuma et al. | |
| 2013/0226415 | A1 * | 8/2013 | Smith | E02F 9/2235 701/50 |
| 2013/0228070 | A1 | 9/2013 | Kim | |
| 2014/0121840 | A1 | 5/2014 | Mizuochi et al. | |
| 2014/0320293 | A1 * | 10/2014 | Hunter, Jr. | G01L 19/12 340/626 |
| 2015/0368080 | A1 | 12/2015 | Dal Dosso et al. | |
| 2016/0281323 | A1 | 9/2016 | Imaizumi | |
| 2016/0281331 | A1 | 9/2016 | Ikegami et al. | |
| 2016/0312432 | A1 | 10/2016 | Wang et al. | |
| 2017/0050643 | A1 | 2/2017 | Lambert | |
| 2017/0121929 | A1 | 5/2017 | Martinez | |
| 2017/0191245 | A1 | 7/2017 | Shatters et al. | |
| 2017/0211597 | A1 | 7/2017 | Vigholm et al. | |
| 2019/0010965 | A1 | 1/2019 | Green et al. | |
| 2019/0024345 | A1 | 1/2019 | Thomsen et al. | |
| 2019/0264419 | A1 * | 8/2019 | Myers | E02F 9/2228 |
| 2019/0264422 | A1 * | 8/2019 | Kenkel | E02F 3/422 |

FOREIGN PATENT DOCUMENTS

| | | | |
|---|---|---|---|
| DE | 102007045846 | A1 | 4/2009 |
| DE | 102008012301 | A1 | 9/2009 |
| DE | 112010003335 | T5 | 8/2012 |
| DE | 112012003346 | B4 | 1/2017 |
| EP | 0229083 | B1 | 7/1987 |
| EP | 1862599 | B1 | 7/2013 |
| JP | H03-8929 | A | 1/1991 |
| WO | 2014110336 | A1 | 7/2014 |

OTHER PUBLICATIONS

U.S. Appl. No. 16/182,106, filed Nov. 6, 2018, by Myers et al.
U.S. Appl. No. 15/908,574, filed Feb. 28, 2018, by Kenkel et al.
U.S. Appl. No. 15/908,581, filed Feb. 28, 2018, by Henn et al.
U.S. Appl. No. 15/908,583, filed Feb. 28, 2018, by Lehmann et al.
U.S. Appl. No. 15/908,561, filed Feb. 28, 2018, by Kenkel et al.
U.S. Appl. No. 15/908,565, filed Feb. 28, 2018, by Myers et al.
German Patent Office Examination Report for Application No. 102019202746.6 dated Jan. 29, 2020 (11 pages, statement of relevance included).
German Patent Office Examination Report for Application No. 102019202654.0 dated Dec. 18, 2019 (11 pages, statement of relevance included).
German Patent Office Examination Report for Application No. 102019202754.7 dated Dec. 20, 2019 (11 pages, statement of relevance included).

* cited by examiner

HYDRAULIC DERATE STABILITY CONTROL

FIELD

The disclosure relates to a hydraulic system for a work vehicle.

BACKGROUND

Many industrial work machines, such as construction equipment, use hydraulics to control various moveable implements. The operator is provided with one or more input or control devices operably coupled to one or more hydraulic actuators, which manipulate the relative location of select components or devices of the equipment to perform various operations. For example, loaders may be utilized in lifting and moving various materials. A loader may include a bucket or fork attachment pivotally coupled by a boom to a frame. One or more hydraulic cylinders are coupled to the boom and/or the bucket to move the bucket between positions relative to the frame.

SUMMARY

According to an exemplary embodiment, a work machine includes a mechanical arm and a work implement coupled to the mechanical arm. The work implement is configured to receive a load. A hydraulic actuator is coupled to the mechanical arm to move the arm between a first position and a second position. A sensor unit is configured to detect the load in the work implement. A valve is in fluid communication with the hydraulic actuator for supplying a fluid output to the hydraulic actuator. A controller is in communication with the valve and the sensor unit. The controller is configured to transmit a control signal to the valve to adjust the fluid output to the hydraulic actuator, and wherein the controller is configured to derate the fluid output in response to a signal from the sensor unit that a load is at or above a threshold value.

According to another exemplary embodiment, a work vehicle includes a boom arm coupled to a vehicle body. A work implement coupled to the boom arm, where the work implement configured to receive a load. A hydraulic actuator is coupled to the boom arm to move the boom arm between a first position and a second position. A sensor unit is configured to detect the load in the work implement. A valve is in fluid communication with the hydraulic actuator for supplying a fluid output to the hydraulic actuator. A pump is configured to discharge fluid to the valve. An engine is operatively connected to the pump. A controller is in communication with the valve and the sensor unit. The controller is configured to transmit a control signal to the valve to adjust a fluid output to the valve. The controller is configured to derate the fluid output in response to a signal from the sensor unit that a load is at or above a first setpoint value.

According to another exemplary embodiment, a work vehicle includes a boom arm coupled to a vehicle body. A work implement is coupled to the boom arm, where the work implement configured to receive a load. A hydraulic actuator is coupled to the boom arm to move the boom arm between a first position and a second position. A sensor unit is configured to detect the load in the work implement. A valve is in fluid communication with the hydraulic actuator for supplying fluid to the hydraulic actuator. An operator input is configured to control the boom arm. A controller is in communication with the operator input, the value and the sensor unit. The controller is configured to receive a movement signal from the operator input and transmit a control signal to the valve to provide a first flowrate of fluid to the hydraulic actuator during a normal operation and to transmit a derated control signal to the valve to provide a second flowrate of fluid in response to a signal from the sensor unit that a load is at or above a first setpoint value.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

FIGS. 1-4 illustrate an exemplary embodiment of a work machine depicted as a loader 10. The present disclosure is not limited, however, to a loader and may extend to other industrial machines such as an excavator, crawler, harvester, skidder, backhoe, feller buncher, motor grader, or any other work machine. As such, while the figures and forthcoming description may relate to a loader, it is to be understood that the scope of the present disclosure extends beyond a loader and, where applicable, the term "machine" or "work machine" will be used instead. The term "machine" or "work machine" is intended to be broader and encompass other vehicles besides a loader for purposes of this disclosure.

Figure 1:
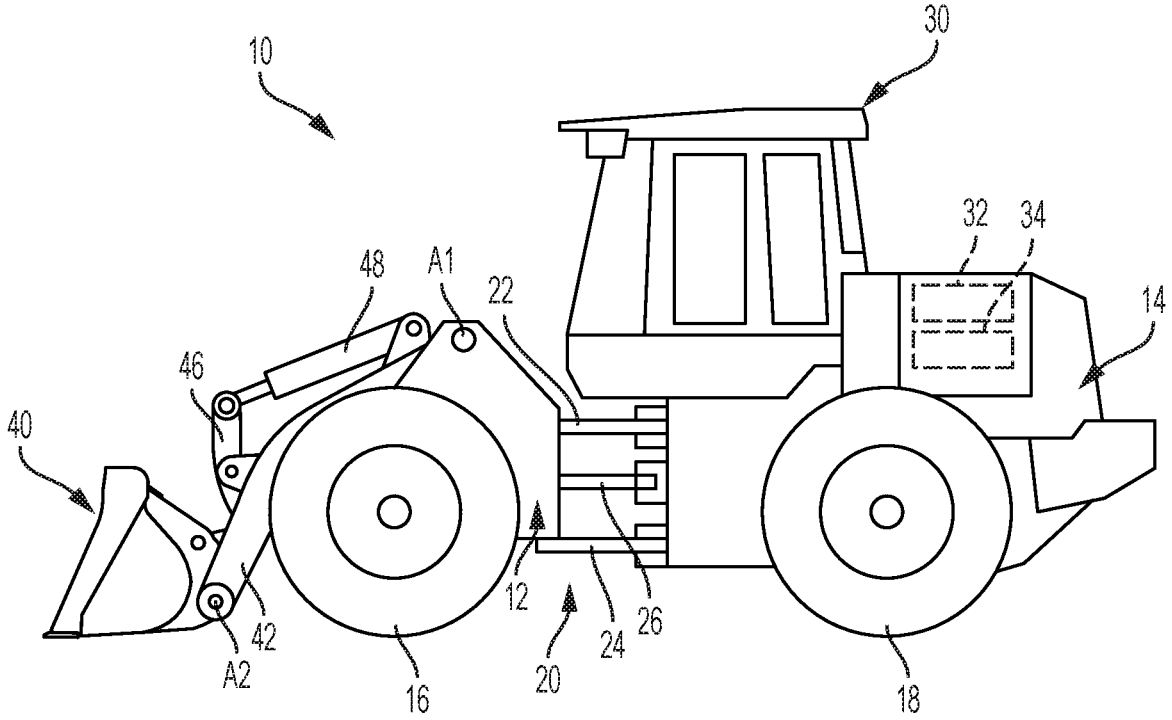
FIG. 1 is a side view of an exemplary work machine with a work implement in a lowered position.

FIG. 1 shows a wheel loader 10 having a front body section 12 with a front frame and a rear body section 14 with a rear frame. The front body section 12 includes a set of front wheels 16 and the rear body section 14 includes a set of rear wheels 18, with one front wheel 16 and one rear wheel 18 positioned on each side of the loader 10. Different embodiments can include different ground engaging members, such as treads or tracks.

The front and rear body sections 12, 14 are connected to each other by an articulation connection 20 so the front and rear body sections 12, 14 can pivot in relation to each other about a vertical axis (orthogonal to the direction of travel and the wheel axis). The articulation connection 20 includes one or more upper connection arms 22, one or more lower connection arms 24, and a pair of articulation cylinders 26 (one shown), with one articulation cylinder 26 on each side of the loader 10. Pivoting movement of the front body 12 is achieved by extending and retracting the piston rods in the articulation cylinders 26.

The rear body section 14 includes an operator cab 30 in which the operator controls the loader 10. A control system (not shown) is positioned in the cab 30 and can include different combinations of a steering wheel, control levers, joysticks, control pedals, and control buttons. The operator can actuate one or more controls of the control system for purposes of operating movement of the loader 10 and the different loader components. The rear body section 14 also contains a prime mover 32 and a control system 34. The prime mover 32 can include an engine, such as a diesel engine and the control system 34 can include a vehicle control unit (VCU).

A work implement 40 is moveably connected to the front body section 12 by one or more boom arms 42. The work implement 40 is used for handling and/or moving objects or material. In the illustrated embodiment, the work implement 40 is depicted as a bucket, although other implements, such as a fork assembly, can also be used. A boom arm can be positioned on each side of the work implement 40. Only a single boom arm is shown in the provided side views and referred to herein as the boom 42. Various embodiments can include a single boom arm or more than two boom arms. The boom 42 is pivotably connected to the frame of the front body section 12 about a first pivot axis A1 and the work implement 40 is pivotably connected to the boom 42 about a second pivot Axis A2.

Figure 2:
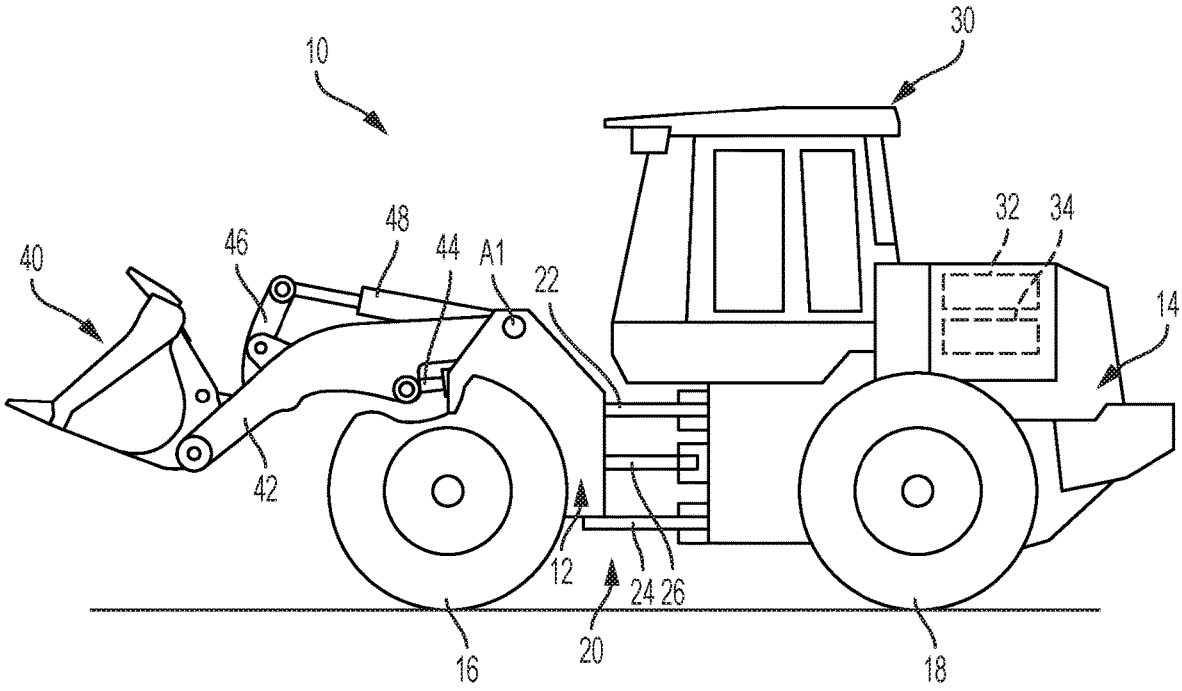
FIG. 2 is a side view of the work machine of FIG. 1 with the work implement in a partially raised position.
Figure 3:
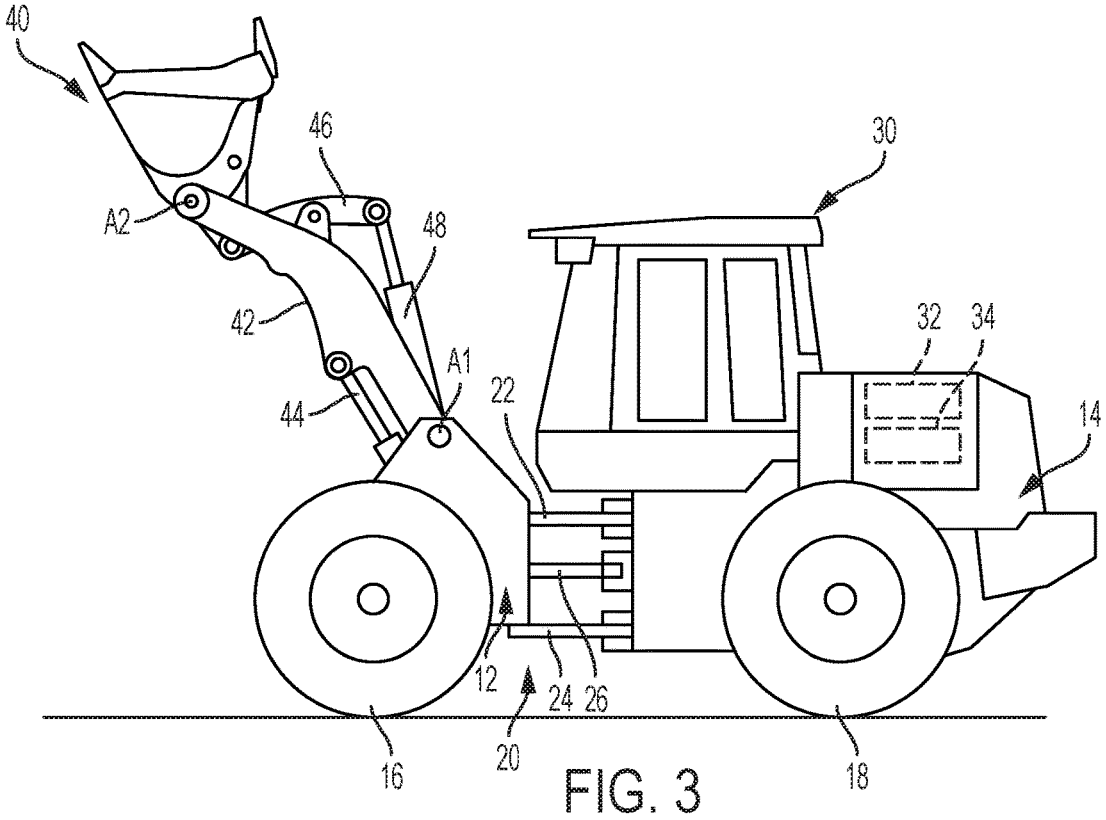
FIG. 3 is a side view of the work machine of FIG. 1 with the work implement in a fully raised position.
Figure 4:
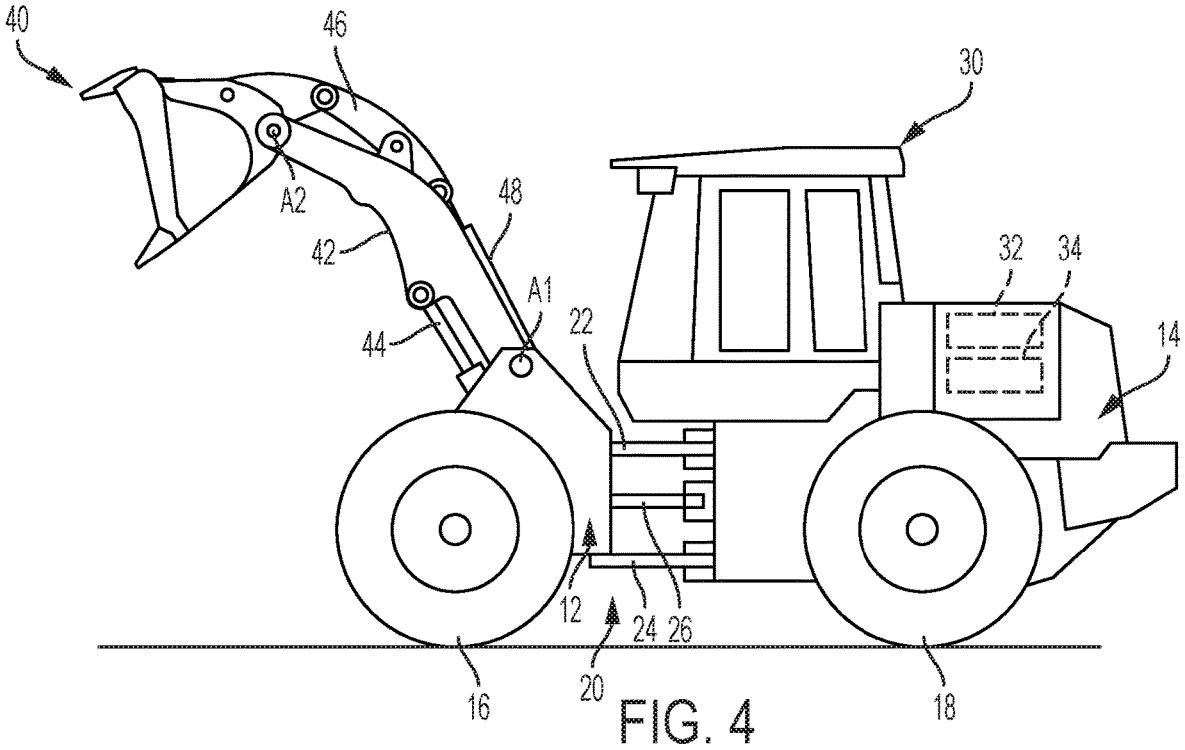
FIG. 4 is a side view of the work machine of FIG. 1 with the work implement in a fully raised and tilted position.

As best shown in FIGS. 2-4, one or more boom hydraulic cylinders 44 are mounted to the frame of the front body section 12 and connect to the boom 42. Generally, two hydraulic cylinders 44 are used with one on each side connected to each boom arm, although the loader 10 may have any number of boom hydraulic cylinders 44, such as one, three, four, etc. The boom hydraulic cylinders 44 can be extended or retracted to raise or lower the boom 42 to adjust the vertical position of the work implement 40 relative to the front body section 12.

One or more pivot linkages 46 are connected to the work implement 40 and to the boom 42. One or more pivot hydraulic cylinders 48 are mounted to the boom 42 and connect to a respective pivot linkage 46. Generally, two pivot hydraulic cylinders 48 are used with one on each side connected to each boom arm, although the loader 10 may have any number of pivot hydraulic cylinders 48. The pivot hydraulic cylinders 48 can be extended or retracted to rotate the work implement 40 about the second pivot axis A2, as shown, for example, in FIGS. 3 and 4. In some embodiments, the work implement 40 may be moved in different manners and a different number or configuration of hydraulic cylinders or other actuators may be used.

Figure 5:
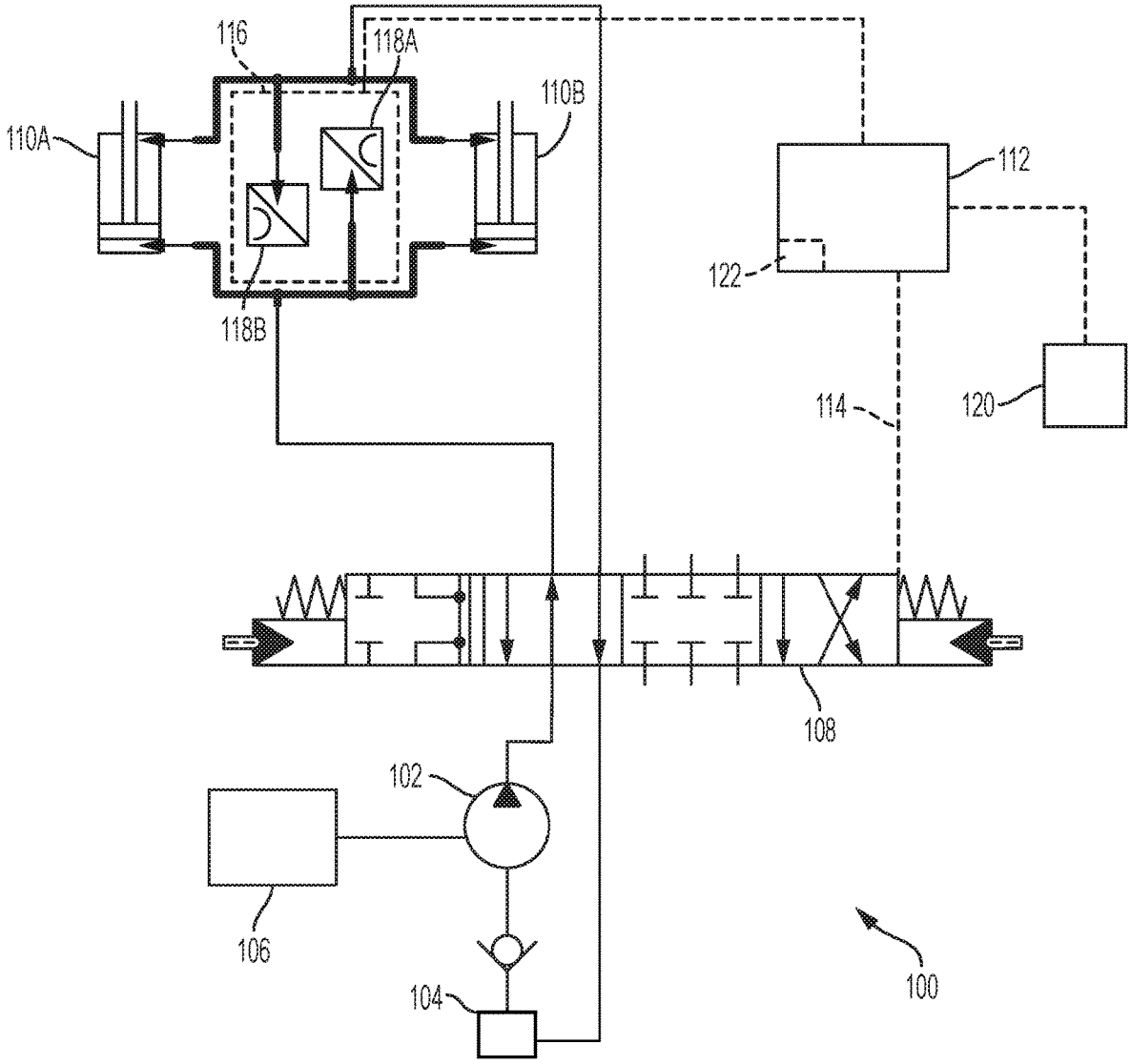
FIG. 5 is a hydraulic system schematic for an exemplary work vehicle.

FIG. 5 illustrates a partial schematic of an exemplary embodiment of a hydraulic and control system 100 configured to supply fluid to implements in the loader 10 shown in FIGS. 1-4, although it can be adapted be used with other work machines as mentioned above. A basic layout of a portion of the hydraulic system 100 is shown for clarity and one of ordinary skill in the art will understand that different hydraulic, mechanical, and electrical components can be used depending on the machine and the moveable implements.

The hydraulic system 100 includes at least one pump 102 that receives fluid, for example hydraulic oil, from a reservoir 104 and supplies fluid to one or more downstream components at a desired system pressure. The pump 102 is powered by an engine 106. The pump 102 can be capable of providing an adjustable output, for example a variable displacement pump or variable delivery pump. Although only a single pump 102 is shown, two or more pumps may be used depending on the requirements of the system and the work machine.

For simplicity, the illustrated embodiment depicts the pump 102 delivering fluid to a single valve 108. In an exemplary embodiment, the valve 108 is an electrohydraulic valve that receives hydraulic fluid from the pump and delivers the hydraulic fluid to a pair of actuators 110A, 110B. The actuators 110A, 110B can be representative of the boom cylinders 44 shown in FIGS. 2-4 or may be any other suitable type of hydraulic actuator known to one of ordinary skill in the art. FIG. 5 shows an exemplary embodiment of two double-acting hydraulic actuators 110A, 110B. Each of the double-acting actuators 110A, 110B includes a first chamber and a second chamber. Fluid is selectively delivered to the first or second chamber by the associated valve 108 to extend or retract the actuator piston. The actuators 110A, 110B can be in fluid communication with the reservoir 104 so that fluid leaving the actuators 110A, 110B drains to the reservoir 104.

The hydraulic system 100 includes a controller 112. In an exemplary embodiment, the controller 112 is a Vehicle Control Unit ("VCU") although other suitable controllers can also be used. The controller 112 includes a plurality of inputs and outputs that are used to receive and transmit information and commands to and from different components in the loader 10. Communication between the controller 112 and the different components can be accomplished through a CAN bus, other communication link (e.g., wireless transceivers), or through a direct connection. Other conventional communication protocols may include J1587 data bus, J1939 data bus, IESCAN data bus, etc.

The controller 112 includes memory for storing software, logic, algorithms, programs, a set of instructions, etc. for controlling the valve 108 and other components of the loader 10. The controller 112 also includes a processor for carrying out or executing the software, logic, algorithms, programs, set of instructions, etc. stored in the memory. The memory can store look-up tables, graphical representations of various functions, and other data or information for carrying out or executing the software, logic, algorithms, programs, set of instructions, etc.

The controller 112 is in communication with the valve 108 and can send a control signal 114 to the pump 102 to adjust the output or flowrate to the actuators 110A, 110B. The type of control signal and how the valve 108 is adjusted will vary dependent on the system. For example, the valve 108 can be an electrohydraulic servo valve that adjusts the flow rate of hydraulic fluid to the actuators 110A, 110B based on the received control signal 114.

One or more sensor units 116 can be associated with the actuators 110A, 110B. The sensor unit 116 can detect information relating to the actuators 110A, 110B and provide the detected information to the controller 112. For example, one or more sensors can detect information relating to actuator position, cylinder pressure, fluid temperature, or movement speed of the actuators. Although described as a single unit related to the boom arm, the sensor unit 116 can encompass sensors positioned at any position within the work machine or associated with the work machine to detect or record operating information.

FIG. 5 shows an exemplary embodiment where the sensor unit 116 includes a first pressure sensor 118A in communication with the first chamber of the actuators 110A, 110B and a second pressure sensor 118B is in communication with the second chamber of the actuators 110A, 110B. The pressure sensors 118A, 118B are used to measure the load on the actuators 110A, 110B. In an exemplary embodiment, the pressure sensors 118A, 118B are pressure transducers. Additional sensors may be associated with the sensor unit 116 and one or more additional sensor units can be incorporated into the system 100.

The controller 112 is also in communication with one or more operator input mechanisms 120. The one or more operator input mechanisms 120 can include, for example, a joystick, throttle control mechanism, pedal, lever, switch, or other control mechanism. The operator input mechanisms 120 are located within the cab 30 of the loader 10 and can be used to control the position of the work implement 40 by adjusting the hydraulic actuators 110A, 110B.

During operation, an operator adjusts the position of the work implement 40 through manipulation of one or more input mechanisms 120. The operator is able to start and stop movement of the work implement 40, and also to control the movement speed of the work implement 40 through acceleration and deceleration. The movement speed of the work implement 40 is partially based on the flow rate of the hydraulic fluid entering the actuators 110A, 110B. The work implement's movement speed will also vary based on the load of the handled material. Raising or lowering an empty bucket can have an initial or standard speed, but when raising or lowering a bucket full of gravel or a fork loaded with lumber, the movement speed of the bucket will be reduced or increased based on the weight of the material.

This change from the standard speed can be unexpected and problematic for operators. For example, when an operator is lowering a bucket full of material, the weight of the material can increase the acceleration of the boom 42 beyond what is expected by the operator and also beyond what is safe. In reaction to, or to compensate for, the increased acceleration, the operator may attempt to slow or stop the boom 42, resulting in a sudden deceleration of the handled material. The deceleration can lead to instability in the material and also the loader 10. This instability can cause damage to the material and can be dangerous to the operator and others in the area.

According to an exemplary embodiment, the controller 112 is configured to derate the flow of the hydraulic fluid to the actuators 110A, 110B based on a detected load. The controller 112 includes a stability module 122 which includes instructions that can automatically derate a boom lower command from the operator input mechanism 120. The stability module 122 can be turned on or off by an operator, for example through operation of switch or control screen input in the cab 30.

Figure 6:
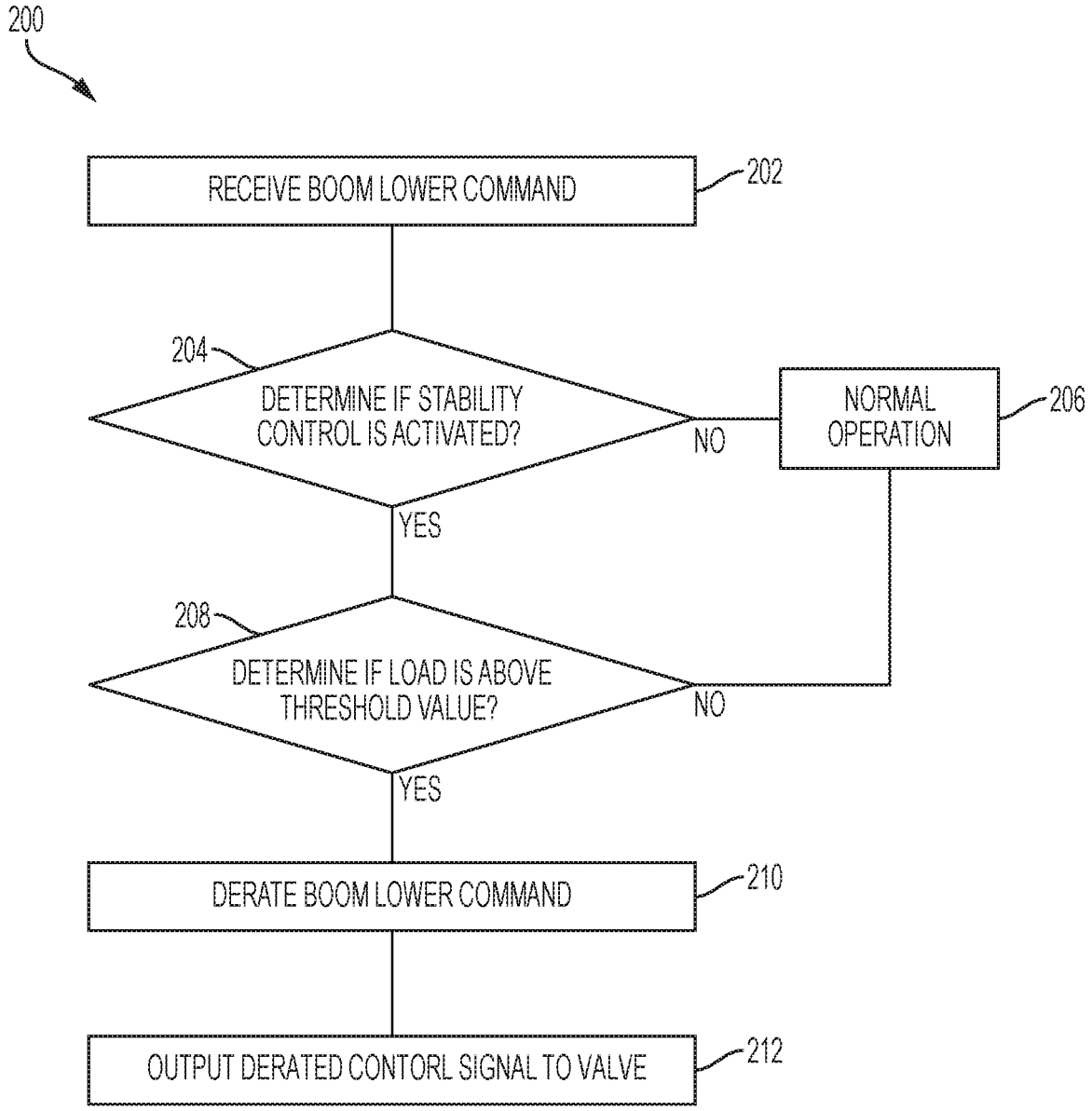
FIG. 6 is a flow chart of an exemplary controller for the hydraulic system.

FIG. 6 shows a partial flow diagram of the instructions to be executed by the controller 112. Typically, when a boom lower command is received by the controller 112, the controller 112 sends a control signal 114 to the valve 108 to supply fluid to the second chamber of the actuators 110A, 110B, retracting the hydraulic pistons. The flow rate of the hydraulic fluid can be based on the force or position of the operator's input or be based on a set rate. The controller 112 initially receives a boom lower command (step 202) and checks to see if the stability control is activated (step 204). If the stability control is not activated, the controller 112 proceeds under normal operation (step 206) and sends the control signal to the valve. If the stability module is activated, the controller 112 determines if the load is above a threshold value (step 208) based on the signal received from the sensor unit 116. If the load is below a threshold value, the controller 112 proceeds under normal operation (step 206) and sends the control signal to the valve. If the load is above the threshold value, the boom lower command is derated (step 210) by a set amount and the derated control signal is sent to the valve (step 212).

Figure 7:
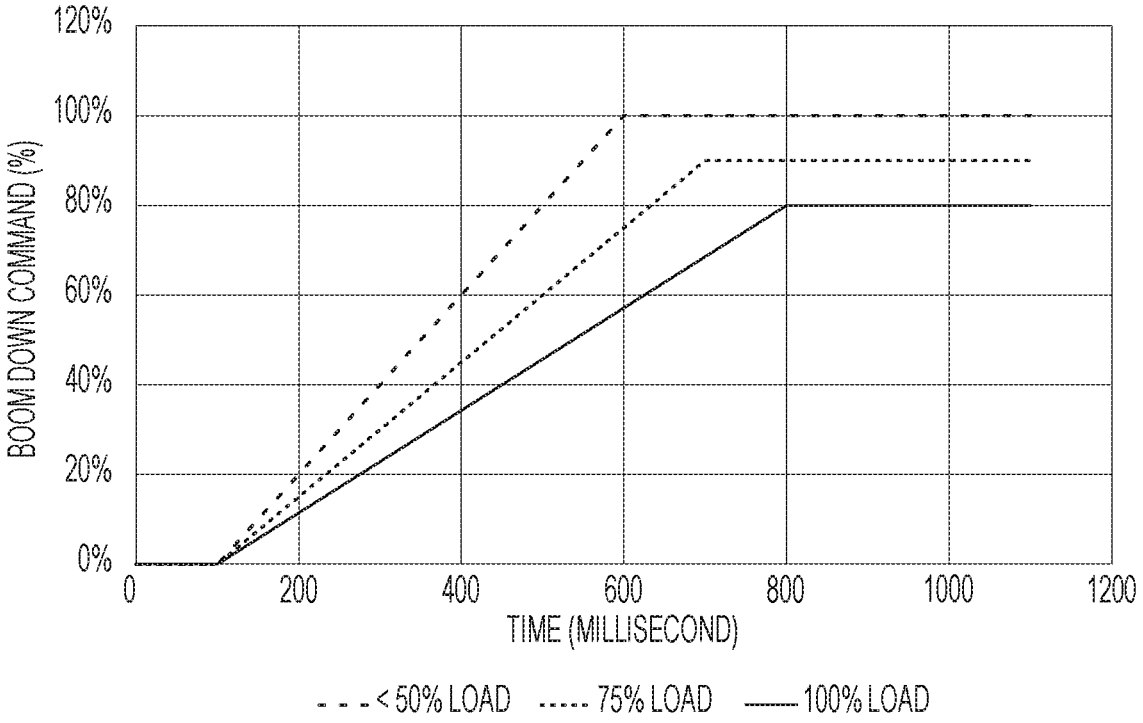
FIG. 7 is a graph showing the control of the boom lower command relative to time.
Figure 8:
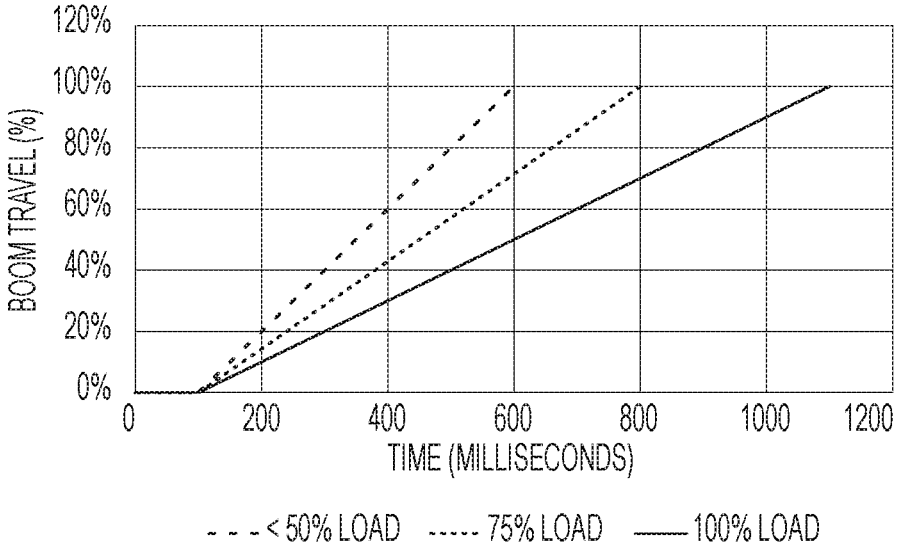
FIG. 8 is a graph showing the boom travel relative to time.

FIG. 7 shows a graph depicting an exemplary deration based on the load. At lower loads, for example less than 50% of the maximum load, the boom lower command is unmodified. In this example, the unmodified command takes approximately 600 milliseconds to reach its maximum level. As the load increases, two parameters change to help improve stability; the boom lower command takes longer to reach its maximum value and the maximum value is reduced. As shown in FIG. 8, at 75% of the maximum load, the command takes approximately 700 milliseconds to each its maximum value, and the maximum value is approximately 90% of the unmodified command. At the maximum load, the command takes approximately 800 milliseconds to reach its maximum value, and the maximum value is approximately 80% of the unmodified command. As shown in FIG. 8, the time it takes for the boom to travel its full distance to its lowest point increases as the boom lower command is derated. The maximum load can be an established safety value, for example the maximum static load (tipping load) or payload as would be understood by one of ordinary skill in the art.

FIGS. 7 and 8 depict three exemplary set points for derating the boom lower command and reducing the flow from the valve 108 to the actuators 110A, 110B. Additional set points, for example every 1%, 5%, 10%, etc. from the minimum value can be used. These values and the resulting derate amounts can be stored in a lookup table that is accessed by the controller 112 or the stability control module 122 to adjust the command signal 114. Instead of using set values, the controller 112 or stability control module 122 can contain an alogrithm using a formula that calculates the derate amount based on the load amount received from the sensor unit 116, so that the derate amount will be at least partially continuously varied based on the load, although different loads may result in the same derate amount based on the configuration of the algorithm or rounding. Additionally, the minimum set point or threshold value can be adjusted to be below 50%.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances or resolutions associated with manufacturing, assembly, and use of the described embodiments and components.

What is claimed:

1. A work machine comprising:

a mechanical arm;

a work implement coupled to the mechanical arm, the work implement configured to receive a load;

a hydraulic actuator coupled to the mechanical arm to move the arm between a first position and a second position;

a sensor unit configured to detect the load in the work implement;

a valve in fluid communication with the hydraulic actuator for supplying a fluid output to the hydraulic actuator; and a controller in communication with the valve and the sensor unit, wherein the controller is configured to transmit a control signal to the valve to adjust the fluid output to the hydraulic actuator, and wherein the controller is configured to determine a derated fluid output in response to the load being at or above a threshold value.

2. The work machine of claim 1, wherein the controller is configured to derate the fluid output a first amount at the threshold value and to derate the fluid output a second amount above the threshold value.

3. The work machine of claim 2, wherein derating the fluid output includes increasing the time to reach a maximum value flowrate relative to a normal operation.

4. The work machine of claim 1, wherein derating the fluid output includes decreasing a maximum flowrate relative to a normal operation.

5. The work machine of claim 1, wherein the sensor unit includes a pressure sensor.

6. The work machine of claim 5, wherein the pressure sensor is operatively connected to the hydraulic actuator.

7. The work machine of claim 1, wherein the controller is a vehicle control unit.

8. The work machine of claim 1, wherein the threshold value is above 50% of a maximum load value.

9. A work vehicle comprising:

a mechanical arm coupled to a vehicle body;

a work implement coupled to the mechanical arm, the work implement configured to receive a load;

a hydraulic actuator coupled to the mechanical arm to move the arm between a first position and a second position;

a sensor unit configured to detect the load in the work implement;

a valve in fluid communication with the hydraulic actuator for supplying a fluid output to the hydraulic actuator;

a pump configured to discharge fluid to the valve;

an engine operatively connected to the pump; and a controller in communication with the valve and the sensor unit, wherein the controller is configured to transmit a control signal to the valve to adjust a fluid output to the valve, and wherein the controller is configured to derate the fluid output in response to the load being at or above a first setpoint value.

10. The work vehicle of claim 9, wherein the controller is configured to derate the valve a first amount when the load reaches the first setpoint value and to derate the valve a second amount when the load reaches a second setpoint value, wherein the second amount is greater than the first amount and the second setpoint value is greater than the first setpoint value.

11. The work vehicle of claim 10, wherein the derate amount increases continuously between the first setpoint and the second setpoint.

12. The work vehicle of claim 10, wherein the derate amount increase in increments at setpoints between the first setpoint and the second setpoint.

13. The work vehicle of claim 10, wherein the first setpoint value is above 50% of a maximum load value and the second setpoint value is at 100% of the maximum load value.

14. The work vehicle of claim 9, wherein the controller is connected to an operator input.

15. The work vehicle of claim 9, wherein the work implement includes a bucket pivotally connected to the boom arm.

16. A work vehicle comprising:

a boom arm coupled to a vehicle body;

a work implement coupled to the boom arm, the work implement configured to receive a load;

a hydraulic actuator coupled to the boom arm to move the boom arm between a first position and a second position;

a sensor unit configured to detect the load in the work implement;

a valve in fluid communication with the hydraulic actuator for supplying fluid to the hydraulic actuator;

an operator input configured to control the boom arm;

a controller in communication with the operator input, the valve and the sensor unit, wherein the controller is configured to receive a movement signal from the operator input and transmit a control signal to the valve to provide a first flowrate of fluid to the hydraulic actuator during a normal operation and to transmit a derated control signal to the valve to provide a second flowrate of fluid in response a load being at or above a first setpoint value.

17. The work vehicle of claim 16, wherein the derated control signal increases the time to reach a maximum flowrate relative to the normal operation.

18. The work vehicle of claim 16, wherein derated control signal decreases a maximum flowrate relative to the normal operation.

19. The work vehicle of claim 16, wherein the sensor unit includes a pressure sensor.

20. The work vehicle of claim 16, wherein the controller is configured transmit a second derated control signal to the valve to provide a third flowrate of fluid in response to a signal from the sensor unit that a load is at or above a second setpoint value.

* * * * *